United States Patent [19]

Stiel et al.

[11] 4,224,795

[45] Sep. 30, 1980

[54] METHOD FOR CONVERTING HEAT ENERGY TO MECHANICAL ENERGY WITH MONOCHLOROTETRAFLUOROETHANE

[75] Inventors: Leonard I. Stiel, Williamsville; Robert A. Allen, Kenmore, both of N.Y.; Kevin P. Murphy, Gladstone, N.J.

[73] Assignee: Allied Chemical Corporation, Morris Township, Morris County, N.J.

[21] Appl. No.: 973,210

[22] Filed: Dec. 26, 1978

[51] Int. Cl.[3] ..... F01K 25/06

[52] U.S. Cl. ..... 60/651; 60/671; 252/67

[58] Field of Search ..... 60/651, 671; 252/67

[56] References Cited

U.S. PATENT DOCUMENTS

| | | |
|---|---|---|
| 2,301,404 | 11/1942 | Holmes . |
| 3,162,580 | 12/1964 | Black et al. . |
| 3,234,738 | 2/1966 | Cook . |
| 3,282,048 | 11/1966 | Murphy . |
| 3,511,049 | 5/1970 | Norton et al. . |
| 3,516,248 | 6/1970 | McEwen . |
| 4,055,049 | 10/1977 | Murphy et al. . |

OTHER PUBLICATIONS

*Geothermal Energy*, J. H. Anderson, "The Vapor–Turbine Cycle for Geothermal Power Generation," Stanford University Press, 1973, Chapter 8.

*Primary Examiner*—Allen M. Ostrager
*Attorney, Agent, or Firm*—Jay P. Friedenson

[57] ABSTRACT

Monochlorotetrafluoroethane is useful as a power fluid with particular suitability for large scale Rankine cycle applications based on systems with moderate temperature heat sources. The fluid is utilized in a Rankine cycle application by vaporizing the fluid by passing the same in heat exchange relationship with a heat source and utilizing the kinetic energy of the resulting expanding vapors to perform work. In this manner heat energy is converted to mechanical energy.

6 Claims, No Drawings

METHOD FOR CONVERTING HEAT ENERGY TO MECHANICAL ENERGY WITH MONOCHLOROTETRAFLUOROETHANE

BACKGROUND OF THE INVENTION

The Government has rights in this invention pursuant to Grant No. GI-42056 awarded by the National Science Foundation.

Methods whereby heat energy, and particularly waste heat energy, is transformed into useful mechanical energy by vapor power (Rankine) cycles is well known. The basic method comprises causing a suitable working or power fluid to pass in heat exchange relationship with a source of heat of sufficient intensity to vaporize the fluid; utilizing the kinetic energy of the expanding vapors to perform work by passing them through a turbine machine or other work producing device, condensing the vapor and pumping the condensed liquid back in heat exchange relationship with the heat source to complete the cycle.

A variety of fluids have been tested in the past as power fluids for this type of application. Water or steam has been the most commercially utilized power fluid. However, the high boiling point, high critical pressure and low density of water or steam limit the power obtainable and result in a need for relatively large and bulky apparatus for these fluids.

A number of organic liquids have been tested as power fluids (e.g. U.S. Pat. Nos. 2,301,404; 3,162,580; 3,234,738; 3,282,048; 3,516,248; 3,511,049 and 4,055,049), but there has not been found any single fluid suitable for use as a power fluid for all applications.

Of particular interest in today's energy economy are those large scale Rankine cycle applications based on systems with moderate temperature heat sources. By moderate temperature heat sources is intended to mean on the order of about 200°–400° F. Illustrative of such applications are those involving geothermal power, waste heat and large scale solar power systems. Isobutane, a flammable fluid, is commonly recommended for applications of this type. This is due to the favorable efficiency, heat transfer characteristics and component sizes which are required with isobutane as compared with other fluids. The flammability of isobutane, however, is a major disadvantage as presenting an obvious hazard.

It is accordingly an object of this invention to identify fluids which offer the same advantages as isobutane for such applications, but which do not suffer from the flammability problem.

Other objects and advantages of the invention will become apparent from the following description.

SUMMARY OF THE INVENTION

It has been found that the objects of the invention are achieved by utilizing monochlorotetrafluoroethane as a working fluid in a Rankine cycle application. In such application, heat energy is converted to mechanical energy by vaporizing a fluid comprising monochlorotetrafluoroethane by passing the same in heat exchange relationship with a heat source and utilizing the kinetic energy of the resulting expanding vapors to perform work.

Monochlorotetrafluoroethane exists in two isomeric forms. Namely 1-chloro,1-fluoro-2,2,2-trifluoroethane (commonly referred to as R-124) and 2-chloro-1,1-difluoro-2,2-difluoroethane (commonly referred to as R-124a). Accordingly, for the purposes herein, monochlorotetrafluoroethane is intended to mean R-124, R-124a or mixtures thereof.

Methods for utilizing monochlorotetrafluoroethane as a working fluid in Rankine cycle applications will be obvious and well understood by those of ordinary skill in the art. Such methods essentially involve converting heat energy to mechanical energy by vaporizing the working fluid by passing the same in heat exchange relationship with a heat source and utilizing the kinetic energy of the resulting expanding vapors to perform work. Such methods are not part of this invention. Detailed descriptions of various Rankine cycle applications and methods of using working fluids in such applications are given, for example, in U.S. Pat. No. 3,282,048. Such applications, methods and techniques are applicable herein.

EXAMPLE

In order to compare the performance of monochlorotetrafluoroethane with isobutane in a typical moderate temperature Rankine cycle system, a comparison was made of the performance of R-124 and R-124a with isobutane. The comparison was based on the Rankine cycle efficiencies for these fluids. The data were based upon 100% turbine efficiency and although are not completely accurate on an absolute basis, are competent for the purpose of showing relative efficiency values.

In the typical moderate temperature Rankine cycle system chosen, a feed pump takes saturated liquid at low pressure and pumps it to high pressure. At this point the fluid enters the boiler where heat is applied. This causes the fluid temperature to increase until boiling is achieved. Further heating in the boiler vaporizes and superheats the fluid. The vapors are then passed through an expansion engine where they expand at constant entropy or nearly so dependent on the engine efficiency. During the expansion process, useful work is done by the expansion engine and the vapors exit at a lower temperature and pressure. The vapors are then cooled further in a condenser where they again reach saturation conditions. Further cooling causes the vapors to condense to the saturated liquid condition, thus completing the cycle.

The Rankine Cycle Efficiency (E) is given by:

$$E = \frac{\text{Turbine Work} - \text{Pump Work}}{\text{Boiler Heat}}$$

Table I compares the parameters for R-124, R-124a, and isobutane for a cycle operating at an expander inlet temperature of 250° F. and a condenser temperature of 120° F. The expander and pump efficiencies are 1.0 and the basis is 10,000 Btu/min as Boiler Heat.

Table I

| | R-124 | R-124a | Isobutane |
|---|---|---|---|
| Boiler Temperature (°F.) | 242.3 | 245.6 | 248.6 |
| Boiler Pressure (psia) | 478 | 448.0 | 419.8 |
| Mass Flow Rate (lb/min.) | 152.7 | 147.9 | 63.8 |
| Turbine Work (Btu/min.) | 1460 | 1470 | 1512 |
| Temperature After Expansion (°F.) | 123.5 | 129.5 | 134.6 |
| Pump Work (Btu/min.) | 131 | 125 | 124 |
| Condenser Pressure (psia) | 108.8 | 99.5 | 96.1 |
| Volumetric Flow Rate at Turbine Outlet ($ft^3$/min.) | 53.6 | 58.4 | 62.7 |

Table I-continued

| | R-124 | R-124a | Isobutane |
|---|---|---|---|
| Efficiency × 100 | 13.3 | 13.5 | 13.9 |

The above Table shows that the efficiencies for R-124 and R-124a (monochlorotetrafluoroethane) at the indicated cycle are approximately equivalent to the efficiency of isobutane. Significantly, the volumetric flow rate at the turbine outlet is lower for R-124 and R-124a than isobutane, indicating that the size of the turbine required for these fluids would be less than that required for isobutane.

The efficiencies and other cycle characteristics were calculated using generalized thermodynamic relationship as described in the paper: "Optimum Properties of Working Fluids for Solar-Powered Heat Pumps," Stiel et al., 10th Intersociety Energy Conversion Engr. Conference, Newark, Del. Aug. 1975.

The physical properties of R-124, R-124a and isobutane used in these calculations are shown in Table II. With the exceptions noted these properties were experimentally determined.

Table II

| | R-124 | R-124a | Isobutane |
|---|---|---|---|
| Critical Temperature, °F. | 252.0 | 259.8 | 274.6 |
| Critical Pressure, psia | 525.4 | 514.5* | 529.2 |
| Critical Density, lbs/cu$^3$ | 34.9 | 33.7* | 13.8 |
| Boiling Point, °F. | 10.3 | 13.4 | 10.7 |
| Ideal Gas Heat Capacity at 80° F., Btu/lb mole °F. | 22.78 | 25.06 | 23.24 |
| Molecular Weight | 136.5 | 136.5 | 58.12 |
| Liquid Density at 68° F., lb/ft$^3$ | 85.7 | 85.5 | 34.8 |

*Estimated by group contribution methods described by R.C. Reid and T.K. Sherwood, Properties of Gases and Liquids, McGraw Hill Book Co., N.Y. 1966.

When identical cycles were operated with R-124, R-124a and isobutane at other expander inlet temperatures, similar results were obtained, that is to say comparable Rankine Cycle Efficiencies were obtained, thereby demonstrating that monochlorotetrafluoroethane is a substitute for isobutane in the applications under consideration over a range of temperature conditions. These results are shown in Table III.

Table III

IDEAL RANKINE CYCLE EFFICIENCIES

| | R-124 | R-124a | i-$C_4H_{10}$ |
|---|---|---|---|
| $T_u$ = 200° F., Percent Efficiency (E) | 10.1 | 10.2 | 10.2 |
| $T_u$ = 300° F., Percent Efficiency (E) | 15.2 | 15.2 | 15.7 |
| $T_u$ = 350° F., Percent Efficiency (E) | 17.6 | 17.5 | 17.7 |

Tests were made on monochlorotetrafluoroethane with a Bureau of Mines flammability tube and this material was found to be non-flammable. Monochlorotetrafluoroethane is cited as a non-flammable gas by the U.S. Department of Transportation (FEREAC 41, 57018, 76), while isobutane is cited as a flammable gas.

Additives, such as lubricants, corrosion inhibitors and others may be added to the monochlorotetrafluoroethane working fluid for a variety of purposes provided they do not have an adverse influence on the fluid for the intended application.

We claim:

1. The method for converting heat energy to mechanical energy which comprises vaporizing a fluid comprising monochlorotetrafluoroethane by passing the same in heat exchange relationship with a heat source and utilizing the kinetic energy of the resulting expanding vapors to perform work.

2. The process of claim 1 in which the monochlorotetrafluoroethane is 1-chloro,1-fluoro-2,2,2-trifluoroethane.

3. The method according to claim 1 in which the monochlorotetrafluoroethane is 2-chloro-1,1-difluoro-2,2-difluoroethane.

4. The method according to claim 1 in which the heat source is on the order of about 200°–400° F.

5. The method according to claim 4 in which the monochlorotetrafluoroethane is 1-chloro,1-fluoro-2,2,2-trifluoroethane.

6. The method according to claim 4 in which the monochlorotetrafluoroethane is 2-chloro-1,1-difluoro-2,2-difluoroethane.

* * * * *